US006827614B2

(12) United States Patent
Bechaz et al.

(10) Patent No.: US 6,827,614 B2
(45) Date of Patent: Dec. 7, 2004

(54) SPRING FOR CONNECTING AN ELECTRICAL CONDUCTOR

(75) Inventors: Bernard Bechaz, Caluire (FR); Philippe France, Chazelles sur Lyon (FR)

(73) Assignee: Enetrelec SA, Lyons (FR)

( * ) Notice: Subject to any disclaimer, the term of this patent is extended or adjusted under 35 U.S.C. 154(b) by 0 days.

(21) Appl. No.: 09/860,478

(22) Filed: May 21, 2001

(65) Prior Publication Data

US 2001/0049236 A1 Dec. 6, 2001

(30) Foreign Application Priority Data

May 24, 2000 (FR) ..... 00 06657

(51) Int. Cl.[7] ..... H01R 4/48
(52) U.S. Cl. ..... 439/834; 439/828
(58) Field of Search ..... 439/834, 835, 439/826, 789

(56) References Cited

U.S. PATENT DOCUMENTS 5,938,484 A * 8/1999 Beege et al. ..... 439/828
6,010,376 A 1/2000 Kollmann ..... 439/834
6,146,186 A * 11/2000 Barrat et al. ..... 439/410
6,283,801 B1 * 9/2001 Guinda et al. ..... 439/835

FOREIGN PATENT DOCUMENTS

| | | |
|---|---|---|
| DE | 31 22 303 A1 | 1/1983 |
| DE | 37 27 091 C1 | 2/1989 |
| DE | 198 05 903 C1 | 7/1999 |
| EP | 0 597 190 A1 | 8/1993 |

* cited by examiner

*Primary Examiner*—Chandrika Prasad
(74) *Attorney, Agent, or Firm*—Oliff & Berridge, PLC

(57) ABSTRACT

The connecting spring is made of a flat elastic material with a certain thickness which has a pressing branch which is intended to rest against a conducting strip of a connection terminal, a moving branch, having on a same side of a free end, a more or less flat part with an opening intended for the passage of the end of a conductor that is to be connected and, a rear part facing the pressing branch, and a connecting region connecting the pressing branch to the moving branch, forming a loop. The pressing branch has an elbow toward an inside of the loop forming a first side of the elbow facing the conducting strip so that when the pressing branch is pressed against the conducting strip, a distance separating the first side of the elbow from a second side of the conducting strip facing the elbow is greater than the thickness of the material used to make the spring.

12 Claims, 1 Drawing Sheet

SPRING FOR CONNECTING AN ELECTRICAL CONDUCTOR

BACKGROUND OF THE INVENTION

The present invention relates to a connecting spring. Such spring is used, for example, in a connection terminal to connect an electrical conductor.

It is known to use springs for holding the end of a stripped conductor against a current supply rail, in a connection terminal. Documents DE-37 27 091 and DE-42 37 733 describe connection terminals of this type. These documents disclose a connecting spring made of a flat elastic material bent into a loop. The connecting spring has a pressing branch intended to rest against a connecting strip or a current supply rail, a gripping branch folded from the rear part of the connecting spring and running transversely to the connecting strip, and an elastic arc connecting together the pressing branch and the rear part from behind. A window intended to accommodate an end of a stripped conductor and the end of the connecting strip is made in the gripping branch. The stripped end of a conductor is laid along the connecting strip on the opposite side to the pressing branch of the spring. Thus, the spring presses this stripped end against the conducting strip.

A device of this type may also be used for making a self-stripping connection of an electrical cable. In this case, the spring is used to store up the energy needed to strip the insulation off an electrical cable and trap it in a connecting slit and to restore this energy at the appropriate time.

These connecting springs have to guarantee a pressing force exerted on the stripped conductor toward the connecting strip so as to obtain a good contact pressure and thereby a good electrical connection. These relatively high forces lead to high internal stresses, particularly when the spring is stressed. These stresses appear more particularly in the elastic arc.

In order to keep these stresses at a level that is compatible with the properties of the material, the size of the spring has to be increased and this leads to an increase in the bulk and cost of the connection.

SUMMARY OF THE INVENTION

It is an object of the invention therefore to provide a connecting spring in which the stresses are reduced by comparison with a connecting spring of the prior art, without increasing the bulk.

To this end, the invention proposes a connecting spring for an electrical conductor, made of a flat elastic material which has a pressing branch intended to rest against a fixed conducting strip of a connection terminal, a moving branch, having, on the one hand, on a same side of its free end, a more or less flat part with an opening intended for the passage of the end of a conductor that is to be connected and, on the other hand, a rear part facing the pressing branch, and a connecting region connecting the two branches, forming a loop.

According to the invention, the pressing branch has an elbow toward the inside of the loop so that when the pressing branch is pressed against the flat conducting strip, the distance separating the inside of the elbow from the conducting strip is greater than the thickness of the material used to make the spring.

Thus, the pressing branch rests via its two ends on the conducting strip. When the connecting spring is deformed, the two contact points tend to move apart by sliding along the strip, tus opening out the elbow in the pressing branch. This deformation allows some of the stresses needed for stressing the spring to be stored up. The appearance of stresses in the pressing branch makes it possible to reduce the stresses in the connecting region. It is in the latter that the stresses are the highest. The bent shape of the pressing branch thus allows for better distribution of the stresses.

In a preferred embodiment, when the pressing branch is pressed against the flat conducting strip, the distance separating the inside of the elbow from the conducting strip is between two and four times the thickness of the material used to make the spring.

In a connecting spring according to the invention, the part of the spring may, for example, be more or less straight.

BRIEF DESCRIPTION OF THE DRAWINGS

In any case, the invention will be clearly understood with the aid of the description which follows, with reference to the appended schematic drawing which, by way of nonlimiting example, depicts one preferred embodiment of a connecting spring according to the invention.

DETAILED DESCRIPTION OF AN EXEMPLARY EMBODIMENT

Figure 1:
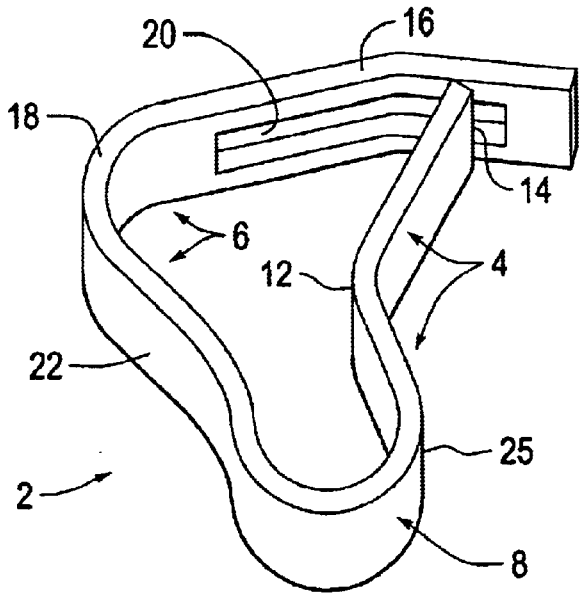
FIG. 1 is a perspective view of this connecting spring.

FIG. 1 shows a connecting spring 2 according to the invention. It has the shape of a loop comprising a pressing branch 4 and a moving branch 6. A connecting region 8 connects the two branches 4 and 6, forming a loop. This spring 2 is made of a strip of flat material, for example a strip of steel sheet.

The pressing branch 4 is intended to rest against a connecting strip 10 at a free end 14 and a connecting end 25 that connects to connecting region 8 at a region of transition. The connecting strip 10 is adjacent a connection terminal 24. The pressing branch 4 is bent to form an elbow 12, having a first side facing a second side of the connecting strip 10.

The pressing branch 4 has a bent shape. Its elbow 12 faces toward the inside of the loop. Thus, the convex shape of the pressing branch 4 is on the inside of the loop of the spring. When the pressing branch 4 rests against the connecting strip 10, it is in contact with this strip more or less at its free end 14 and at its connecting end 25 in the region of transition between the pressing branch 4 and the connecting region 8. On eith side of the elbow 12, the pressing branch 4 has more or less straight and flat sections.

Figure 2:
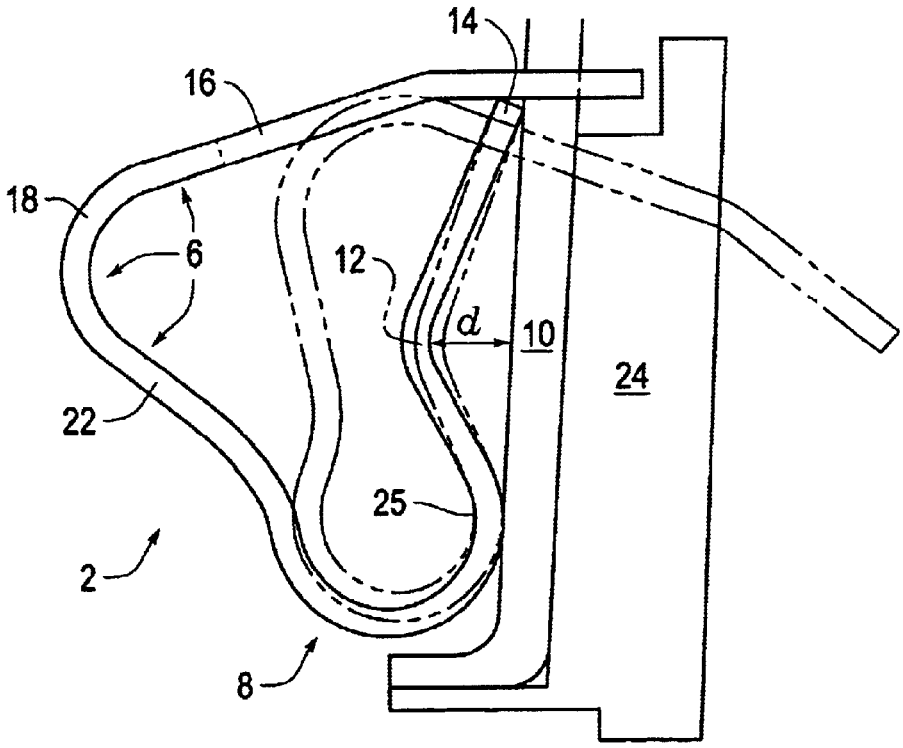
FIG. 2 is a view in elevation of this spring fitted on a connecting strip.

The angle formed at the elbow 12 is about 130°. This angle can vary according to the size of the connecting spring 2. This angle will generally be between 110° and 160°. The distance separating the inside of the elbow from the connecting strip and referenced d in FIG. 2 is more or less equal to three times the thickness of the strip of sheet metal used to make the connecting spring 2. Depending on the embodiments of the invention, this distance d will be greater than the thickness of the strip of material used to make the spring and less than five times this thickness.

The moving branch 6 also has a bent shape. It exhibits a first arm forming a gripping branch 16, a moving elbow 18 and a more or less flat and straight rear part 22. The gripping branch 16 is intended to move more or less perpendicular to the connecting strip 10. The movement of this gripping branch 16 is a translational movement combined with a slight rotation. FIG. 2 shows that over the entire travel of this gripping branch 16, rotation takes place. In FIG. 2, the connecting spring 2 is depicted in solid line in its rest position and in dashed line in its stressed position.

The gripping branch 16 has an opening 20 of elongate rectangular shape running longitudinally with respect to the gripping branch 16. This opening 20 is intended to accommodate, on the one hand, the connecting strip 10 and, on the other hand, a stripped end of a conductor that is to be connected.

The elbow 18 makes an angle of about 90°. It connects the gripping branch 16 to the straight rear part 22 of the connecting spring 2.

A conductor is connected in the conventional way. It is unnecessary to describe it in detail here. When, in order to make a connection, the spring 2 is stressed, the spring adopts the position depicted in dashed line in FIG. 2. It may be noted that the pressing branch is then deformed with respect to the rest position depicted in solid line in that figure. Thus, mechanical stresses arise in the material at this pressing branch. It has been shown that the occurrence of mechanical stresses in the pressing branch made it possible to reduce the stresses at the connecting region 8. This is advantageous because it is in this connecting region 8 that the stresses are the highest. By virtue of the bent shape of the pressing branch 4, it is thus possible to achieve a better distribution of the mechanical stresses imposed on the connecting spring when the latter is stressed between the pressing branch 4 and the connecting region 8. The mechanical stresses at the moving branch remain modest.

As goes without saying the invention is not restricted to the preferred embodiment described hereinabove by way of nonlimiting example. On the contrary, it encompasses all variation that fall within the context of the claims which follow.

What is claimed is:

1. A connecting spring for an electrical conductor, made of a flat elastic material having a thickness, comprising:

a pressing branch having a free end and a connecting end, the free and connecting ends impinging against a fixed conducting strip of a connection terminal, and between the ends the pressing branch is curved to have an elbow;

a moving branch, having, on a same side of the free end, a more or less flat part with an opening intended for passage of an end of a conductor that is to be connected, and a rear part facing the pressing branch; and a connecting region connecting the pressing branch at the connecting end to the moving branch, the connecting region forming a loop, wherein the elbow formed by the pressing branch is elastically deformable to transfer bending stresses from the connecting region to the pressing branch resulting from movement of the rear part of the moving branch towards the pressing branch, and wherein as the pressing branch at the free end and the connecting region at the connecting end are pressed against a planar surface of the conducting strip, a distance separating a side of the elbow facing the conducting strip from the planar surface of the conducting strip facing the elbow is greater than the thickness of the material used to make the spring.

2. The spring according to claim 1, wherein when the pressing branch and the connecting region are pressed against the planar surface of the conducting strip, the distance is less than five times the thickness of the material used to make the spring.

3. The spring according to claim 2, wherein when the pressing branch and the connecting region are pressed against the planar surface of the conducting strip, the distance is between two and four times the thickness of the material used to make the spring.

4. The spring according to claim 1, wherein the angle formed at the elbow of the pressing branch is more or less between 110° and 160°.

5. The spring according to claim 4, wherein the angle at the elbow is more or less equal to 130°.

6. The spring according to claim 1, wherein the rear part of the spring is more or less straight.

7. The spring according to claim 2, wherein the angle formed at the elbow of the pressing branch is more or less between 110° and 160°.

8. The spring according to claim 3, wherein the angle formed at the elbow of the pressing branch is more or less between 110° and 160°.

9. The spring according to claim 2, wherein the rear part of the spring is more or less straight.

10. The spring according to claim 3, wherein the rear part of the spring is more or less straight.

11. The spring according to claim 4, wherein the rear part of the spring is more or less straight.

12. The spring according to claim 5, wherein the rear part of the spring is more or less straight.

* * * * *